US006526708B1

(12) United States Patent
Hartley et al.

(10) Patent No.: US 6,526,708 B1
(45) Date of Patent: Mar. 4, 2003

(54) DOOR FRAME GUARD

(76) Inventors: Briane L. Hartley, 826 Ponderosa Dr., Imperial, PA (US) 15126; Edwin R. Malacki, 2613 Voekel Ave., Pittsburgh, PA (US) 15216

( * ) Notice: Subject to any disclaimer, the term of this patent is extended or adjusted under 35 U.S.C. 154(b) by 0 days.

(21) Appl. No.: 09/943,492

(22) Filed: Aug. 30, 2001

(51) Int. Cl.[7] ..... E06B 1/04

(52) U.S. Cl. ..... 52/211; 52/287.1; 52/DIG. 12; 52/656.1; 52/656.2; 52/215; 52/213; 52/204.1; 49/460; 49/462; 49/57; 248/345.1

(58) Field of Search ..... 52/287.1, DIG. 12, 52/656.1, 656.2, 215, 716.1, 211, 204.53, 656.4, 717.01, 716.8, 204.1, 213, 217; 49/57, 462, 460; 248/345.1

(56) References Cited

U.S. PATENT DOCUMENTS

| | | | | | |
|---|---|---|---|---|---|
| 1,620,933 | A | * | 3/1927 | Wilcox | 52/211 |
| 2,611,932 | A | * | 9/1952 | Olssan | 52/211 |
| 3,305,983 | A | * | 2/1967 | Bus | 52/211 |
| 3,897,668 | A | * | 8/1975 | McDonnell | 52/211 |
| 4,443,508 | A | * | 4/1984 | Mehl | 428/122 |
| 4,635,399 | A | * | 1/1987 | Gehrke et al. | 49/460 |
| 4,768,320 | A | * | 9/1988 | Weller | 52/211 |
| 4,858,384 | A | * | 8/1989 | Blankenship | 49/460 |
| 4,999,233 | A | * | 3/1991 | Probst et al. | 428/122 |
| 5,131,186 | A | * | 7/1992 | Lamont | 49/57 |
| 5,446,996 | A | | 9/1995 | Lamont | |
| 5,477,644 | A | * | 12/1995 | Chenoweth, Jr. | 52/126.1 |
| 5,737,878 | A | * | 4/1998 | Raulerson et al. | 52/211 |
| 5,775,045 | A | * | 7/1998 | Hill | 52/211 |
| 5,815,998 | A | * | 10/1998 | Wamsher | 52/211 |
| 5,927,038 | A | * | 7/1999 | Goldberg et al. | 52/632 |
| 6,029,410 | A | * | 2/2000 | Westberg, II et al. | 52/204.1 |
| 6,044,601 | A | * | 4/2000 | Chmela et al. | 52/287.1 |
| 6,128,862 | A | | 10/2000 | Katz | |
| 6,263,630 | B1 | * | 7/2001 | Bennett | 52/312 |
| 6,354,049 | B1 | * | 3/2002 | Bennett | 52/287.1 |
| 6,357,187 | B1 | * | 3/2002 | Haldeman | 52/211 |

* cited by examiner

*Primary Examiner*—Lanna Mai
*Assistant Examiner*—Dennis L. Dorsey
(74) *Attorney, Agent, or Firm*—Carothers & Carothers

(57) ABSTRACT

A removable and reusable door frame guard for installation over and providing temporary protection to door trim attached to a door jamb. The guard includes a relatively rigid elongate upright member of shock absorbing material with an L-shaped cross section for covering adjacent bottom, front and inside portions of a vertical door jamb to be protected, and an expandable clamp means is secured to an upper end of the upright member and dimensioned in position for expanding and thereby engaging a bottom surface of a horizontal door header to hold the upright member in position.

8 Claims, 3 Drawing Sheets

FIG. 2A
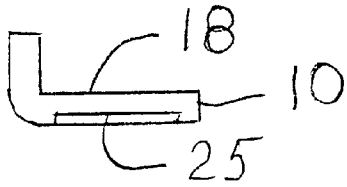
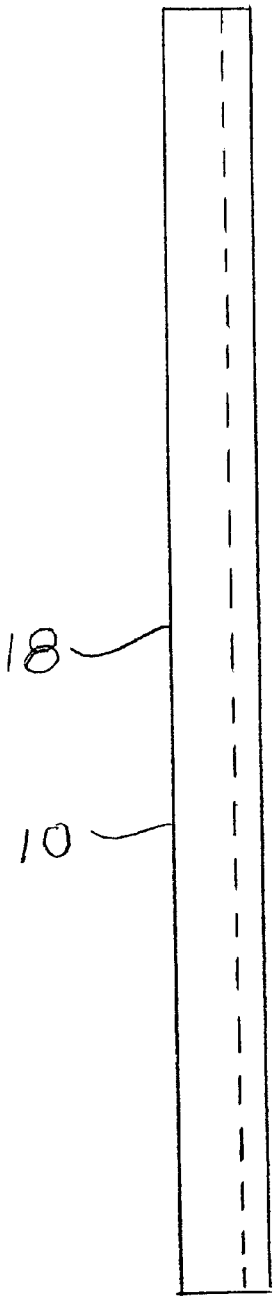
FIG. 2B
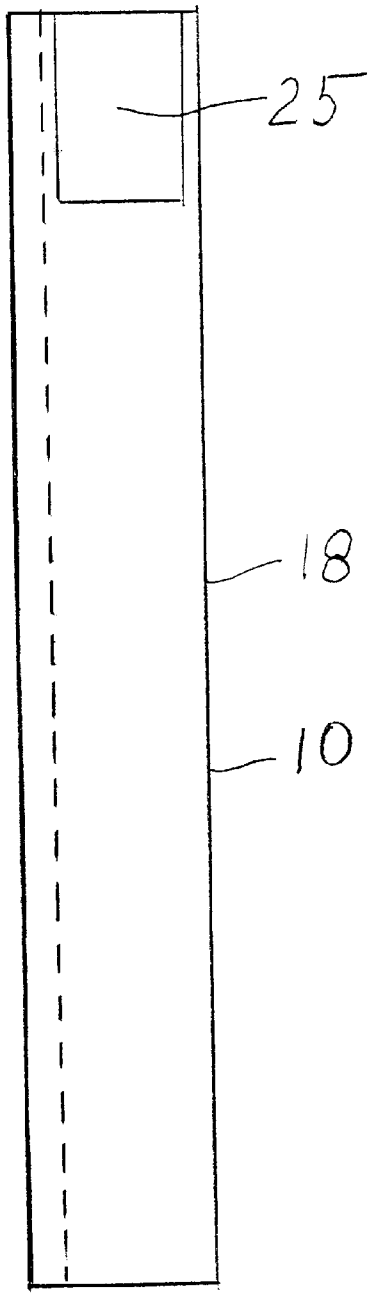
FIG. 2C

DOOR FRAME GUARD

BACKGROUND OF THE INVENTION

The present invention relates generally to protective covers, and more particularly, to a protective cover especially adapted to cover and guard a portion of a door jamb.

During periods of construction, moving of furniture and/or large equipment during repair, such as, the repair of air conditioning units, door jambs and door trim, and particularly elevator doors with decorative stainless steel trim on the exterior jambs, are subject to damage by equipment and materials that must pass through the door openings. Consequently, door guards or protective devices are provided for the lower portions of the door jambs.

However, existing door guards are either too heavy to be truly portable, are inflatable and therefore subject to puncture, do not have adequate means for securing them to the door jambs or have a securing mechanism which must be left permanently attached to the door jamb thereby leaving unsightly parts remaining on the decorative trim surface.

SUMMARY OF THE INVENTION

The removable and reusable door frame guard of the present invention is dimensioned for installation over and provides temporary protection for door trim attached to a doorjamb. The door frame guard of the present invention is particularly suitable for entrance doorways for elevators, but is, of course, usable for other door jambs.

The door frame guard of the present invention is comprised of a relatively rigid elongated upright member of shock absorbing material with an L-shaped cross section for covering adjacent bottom front and inside portions of a vertical doorjamb to be protected. In addition, an expandable clamp mechanism is secured to an upper end of the upright member and dimensioned and positioned for expanding and thereby engaging a bottom surface of a horizontal door header to hold the upright member in position.

The upright member is preferably composed of or has a compressible plastic foam core, such as a closed cell polyethylene-polystyrene combination foam in order to provide a resilient member which has memory and will adequately protect the door jamb which it covers.

The expandable clamp mechanism is easily and quickly actuated for engagement or release and is a hand actuated expandable bar clamp which is secured to the upper end of the relatively rigid elongate upright member. A preferred means of securing the clamp mechanism to the upright member is to secure the bar clamp to a plate and in turn secure the plate to the member, such as with glue. A recess may be provided in the upper end of the upright member which is dimensioned to receive this mounting plate. The plate is then glued into the recess permanently.

BRIEF DESCRIPTION OF THE DRAWINGS

Other objects and advantages appear hereinafter in the following description and claims. The accompanying drawings show, for the purpose of exemplification, without limiting the invention, certain practical embodiments of the present invention wherein:

FIG. 2A is a top or end view of the lefthand door frame guard shown in FIG. 1 with the clamp mechanism removed;

FIG. 2B is a left edge view in side elevation of the door frame member shown in FIG. 2A;

FIG. 2C is a front view in elevation of the door frame guard member shown in FIGS. 2A and 2B.

DETAILED DESCRIPTION OF THE PREFERRED EMBODIMENT

Figure 1:
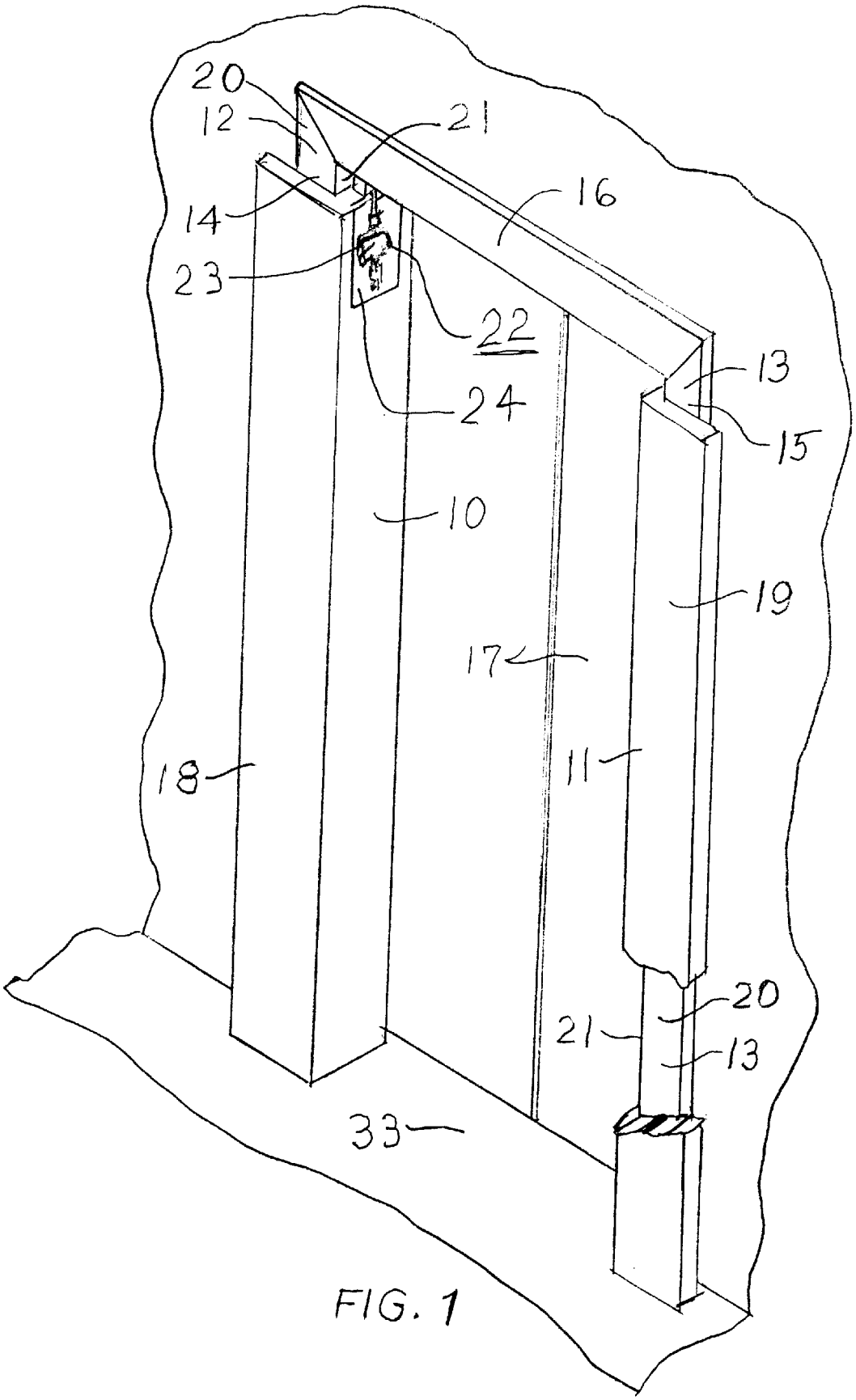
FIG. 1 is a perspective view of the removable and reusable door frame guard of the present invention applied to the door trim on the door jambs of an elevator door opening.

Referring first to FIG. 1, the removable and reusable door frame guard is. provided in the form of two door frame guards 10 and 11 for installation over and providing temporary protection to door trim 12 and 13 which is decorative stainless steel trim attached to and secured over and made part of door jambs 14 and 15. The vertical door jambs 14 and 15 are provided with a horizontal header 16 connecting the upper ends of jambs 14 and 15. In combination they define a door opening for elevator doors 17.

The door frame guards 10 and 1 1 are mirror images of each other and they include relatively rigid elongate upright members 18 and 19 which have an inner core of compressible plastic foam material such as closed cell polyethylene, closed cell polystyrene or preferably a combination closed cell polyethylene-polystyrene foam. This foam core may or may not be provided, as desired, with an outer resilient plastic skin.

These upright elongate members 18 and 19 are thus constructed of light weight and relatively rigid material which has good shock absorbing capabilities and memory in order to return them, to a reasonable degree, to their original dimension when they are impacted and dented. Their L-shaped cross sections are dimensioned for covering adjacent bottom portions of front and inside jamb faces 20 and 21 of the vertical door jambs 13.

The door frame guards 10 and 11 of the present invention are further provided with expandable clamp mechanisms 22 which include expandable hand actuated bar clamps 23 secured to plates 24, which plates are in turn secured to the upper ends of relatively rigid elongate upright members 18 and 19. The details of the upright members 18 and 19 are illustrated in FIGS. 2A, 2B and 2C, and the details of the clamp mechanism 22 is provided in FIG. 3.

With reference to FIGS. 2A, 2B and 2C, the door frame members 18 and 19 are provided with a recess 25 which is dimensioned to receive plate 24 of clamp mechanism 22. The back of plates 24 is glued to members 18 and 19 in respective recesses 25.

Figure 3:
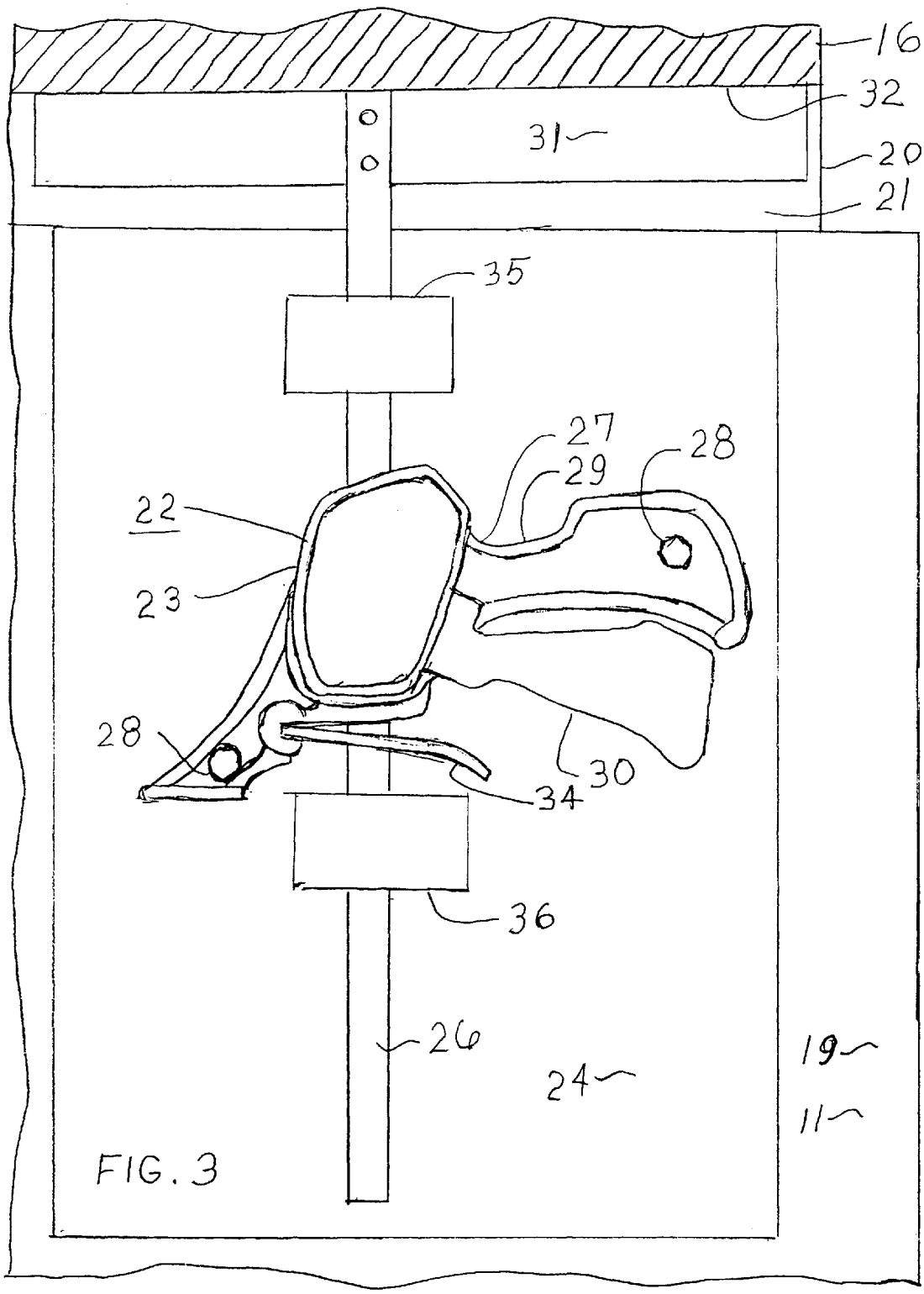
FIG. 3 is an enlarged view in elevation of the clamp mechanism secured to the upper end of the door frame guard for the right hand side of the door frame guard shown in FIG. 1.

Referring to FIG. 3, the clamp 23 is illustrated in detail.

The clamp 23 of clamp mechanism 22 is basically, in part, a portion of an expandable clamp which is readily available on the market and is sold under the trademark QUIK-GRIP. The clamp is basically a bar type clamp, including vertical bar 26 and clamp actuator body 27. Clamp body 27 is bolted to plate 24 with bolts 28. Clamp body 27 is provided with hand grip 29 and actuating trigger 30. When trigger 30 is squeezed upwardly towards hand grip 29, the mechanism actuates to move clamp bar 26 upward in incremental amounts with each squeeze of trigger 30 in order to force horizontal clamp bar 31, which is secured to the upper end of clamp bar 26, upwardly against the under side 32 of header 16. Thus, with upper clamp bar 31, pressure is applied against the underside 32 of header 16 and the bottom end of the members 18 or 19 are therefore pressured against the floor surface 33 (FIG. 1) to hold the door frame guards 10 and 11 in place.

When it is desired to remove the door frame guards 10 and 11, release trigger 34 is pushed upwardly and this releases the grip of the clamp on clamp bar 26 and permits clamp bar 26, together with its horizontal clamp bar 31, to fall downwardly and disengage from the underside 32 of header 16. The sliding vertical movement of clamp bar 26 is guided by slide guides 35 and 36.

We claim:

1. A removable and reusable door frame guard for installation over and providing temporary protection to door trim attached to a door jamb, comprising:

a relatively rigid elongate upright member of shock absorbing material with an L-shaped cross section for covering adjacent bottom front and inside portions of a vertical door-jamb to be protected;

expandable clamp means secured to an upper end of said upright member and dimensioned and positioned for expanding and thereby engaging a bottom surface of a horizontal door header to hold said upright member in position; and a door frame providing two spaced vertical door jambs with a horizontal header connecting upper ends of said jambs, said jambs having front and inside faces to be protected, and a pair of said upright members with said expandable clamp means respectively covering lower portions of said front and inside portions of said door jambs with said clamp means engaging a bottom surface of said header.

2. The door frame guard of claim 1 wherein said upright member includes an inner compressible plastic foam core.

3. The door frame guard of claim 2 wherein said plastic foam core is a closed cell polyethylene-polystyrene combination foam.

4. The door frame guard of claim 1 wherein said expandable clamp means includes a hand actuated expandable bar clamp secured to a plate and said plate in turn secured to said member.

5. The door frame guard of claim 4 including a recess in said upright member dimensioned to receive said plate.

6. The door frame guard of claim 5 wherein said plate is glued to said member in said recess.

7. The door frame guard of claim 6 wherein said upright member includes an inner compressible plastic foam core.

8. The door frame guard of claim 7 wherein said plastic foam core is a closed cell polyethylene-polystyrene combination foam.

* * * * *